US007764896B2

(12) United States Patent
Li et al.

(10) Patent No.: US 7,764,896 B2
(45) Date of Patent: Jul. 27, 2010

(54) METHOD AND APPARATUS FOR DYNAMIC POWER MANAGEMENT IN MARKING DEVICES

(75) Inventors: Faming Li, Penfield, NY (US); Eric Scott Hamby, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 388 days.

(21) Appl. No.: 12/023,563

(22) Filed: Jan. 31, 2008

(65) Prior Publication Data

US 2009/0196645 A1 Aug. 6, 2009

(51) Int. Cl.
*G03G 15/20* (2006.01)

(52) U.S. Cl. ..... 399/70

(58) Field of Classification Search ..... 399/33, 399/70, 88, 67, 122, 307, 320, 322, 327, 399/400; 219/216; 347/156
See application file for complete search history.

(56) References Cited

U.S. PATENT DOCUMENTS 5,600,406 A * 2/1997 Aikawa et al. ..... 399/70
6,249,657 B1 * 6/2001 Kagawa ..... 399/67
6,353,718 B1 3/2002 Roxon et al.
6,490,423 B2 12/2002 Horobin et al.
6,757,503 B2 6/2004 Kamimura
6,901,226 B2 5/2005 Claassen
7,675,196 B2 * 3/2010 Kimura ..... 307/52
2005/0158063 A1 * 7/2005 Mizuno ..... 399/45
2005/0191076 A1 * 9/2005 Dan ..... 399/70
2007/0059017 A1 * 3/2007 Omura ..... 399/88
2008/0181641 A1 * 7/2008 Mori ..... 399/69

* cited by examiner

*Primary Examiner*—David P Porta
*Assistant Examiner*—Kiho Kim
(74) *Attorney, Agent, or Firm*—Ronald E. Prass, Jr.; Prass LLP

(57) ABSTRACT

A method and apparatus for operating a fuser in a marking device is disclosed. The method may include determining a total power available for warm-up of fuser elements in a fuser, determining power constraints of the fuser elements, selecting a power allocation to be applied to the fuser elements, calculating a fuser warm-up time based on the determined total power available, the determined power constraints, and the selected power allocation, determining whether the fuser warm-up time is reduced, wherein if the fuser warm-up time is reduced, applying the selected power allocation.

23 Claims, 7 Drawing Sheets

METHOD AND APPARATUS FOR DYNAMIC POWER MANAGEMENT IN MARKING DEVICES

BACKGROUND

Disclosed herein are a method and apparatus for dynamic power management in marking devices, as well as corresponding apparatus and computer-readable medium.

Marking fusers typically use multiple heating elements (e.g., lamps) throughout the system. For instance, in a roll-based fuser there may be heating elements within the fuser roll, the pressure roll, and external heat rolls. These heating elements may operate independently inside the various rolls to provide the necessary heat in the fusing nip to achieve fix and gloss requirements. During the warm-up process, all the roll surface temperatures need to reach a specified range before printing begins.

For current fusing configurations, some rolls heat-up to their prescribed target range faster than other rolls due to differences in materials, geometry, fuser element power, etc. This is an important observation because the fuser warm-up time is determined by the last roll reaching its set point. For example, a copier may have external heat rolls that may heat up in 4 minutes, a pressure roll that may heat up in 4 minutes, and a fuser roll that may heat up in 8 minutes. Therefore, the warm-up time for the copier is 8 minutes because it is constrained by the roll with the longest warm-up time. In this example, it turns out that the distribution of fuser element power to the various rolls has not been optimized with respect to the temperature dynamics during warm-up.

SUMMARY

A method and apparatus for operating a fuser in a marking device is disclosed. The method may include determining a total power available for warm-up of fuser elements in a fuser, determining power constraints of the fuser elements, selecting a power allocation to be applied to the fuser elements, calculating a fuser warm-up time based on the determined total power available, the determined power constraints, and the selected power allocation, determining whether the fuser warm-up time is reduced, wherein if the fuser warm-up time is reduced, applying the selected power allocation.

DETAILED DESCRIPTION

Figure 1:
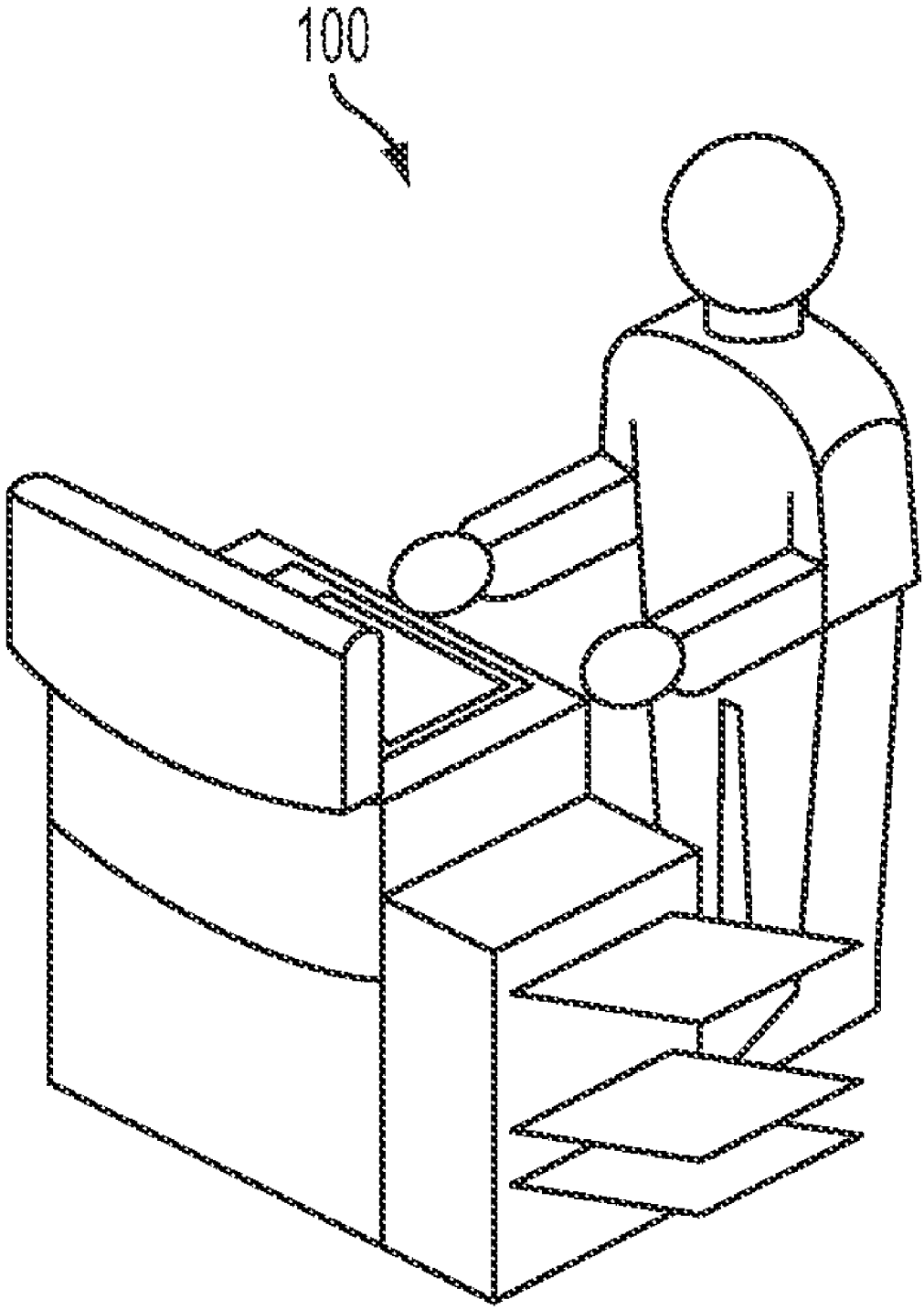
FIG. 1 illustrates an exemplary diagram of a marking device in accordance with one possible embodiment of the disclosure.

Aspects of the embodiments disclosed herein relate to a method for dynamic power management in marking devices, and corresponding apparatus and computer readable medium.

One embodiment may describe a copying machine, printer, or other device using a marking system that may utilize synthetic covered or coated rollers or belts. Such devices are usually power inefficient.

In traditional fuser design, the total fuser element power may be selected first. Then, control may be designed to manipulate the available power during operation. However, in this disclosure, the fuser element power may be determined by the control to achieve the best performance. This process may follow an economic system design approach so that for a given set of resources and constraints, feedback control and resource allocation may be performed so that best performance is achieved and no constraint is violated. For the fuser temperature control during the warm up process, the resource may be the total fuser element power and the constraint may be overheat in the fuser roll core, and the performance criterion may be the warm-up time. That is, To reduce or minimize warm-up time with respect to fuser element power distribution:

Resource: Total fuser element power$\leqq$available power $\overline{P}$

Constraints: Core temperature$\leqq$given upper bound $\overline{T}_{core}$

System model: Fuser temperature dynamics

Thus, to reduce up time for a given total power, the power distribution among fusing rolls may be found so that the warm up time is reduced without over-temp in the fuser roll core.

There are a few heating elements (e.g., fuser elements such as lamps, heaters, coils, etc.) in a hot roll fuser. They operate independently to provide heat to melt the toner. During the warm-up process, the temperature on all rolls needs to reach the set range. Some rolls heat up fast and some slowly due to the difference in material, geometry and fuser element power etc. The warm up time is determined by the last roll reaching its set range. For current large office machines, for example, that is the time for the fuser roll surface temperature to reach 168° C. Thus, this disclosure proposes a faster warm up strategy via fuser element power management by allocating more power to rolls that would otherwise heat-up slowly so that all rolls reach their set points at the same time, while the total power is subject to a supply constraint.

Fast warm-up is the objective of fuser temperature control during the warm-up process. More power is necessary for faster warm up. However, more power may cause flicker and overheat in the fuser core which in turn may cause debond and overstress may cause fuser fatigue over time. When the debond risk and fuser life are considered, it is important to allocate fuser element power and design the fuser temperature control with consideration of fuser core temperature constraint.

In this disclosure, model predictive control (MPC) may address this constraint. MPC is the only generic control technology which may routinely consider equipment and safety constraints. Model predictive controllers may base control actions on an internal plant model of the process. The internal model allows the controller to forecast future process behavior and respect output constraints. The ability to update the internal model makes MPC easier to maintain than complex coupled Proportional-Integral-Derivative (PID) loops that require individual tuning when system parameters change. Fusing temperature control has slow dynamics, permitting plenty of time for the on-line optimization necessary for MPC. Furthermore, when more sophisticated fusing process models are used, a nonlinear MPC may be easy to adapt.

The disclosed embodiments may include a method for operating a fuser in a marking device. The fuser has a number of fuser elements associated therewith. The method may include determining a total power available for warm-up of fuser elements in a fuser, determining power constraints of the fuser elements, selecting a power allocation to be applied to the fuser elements, calculating a fuser warm-up time based on the determined total power available, the determined power constraints, and the selected power allocation, determining whether the fuser warm-up time is reduced, wherein if the fuser warm-up time is reduced, applying the selected power allocation.

The disclosed embodiments further include a fusing apparatus in a marking device. The fusing apparatus may include a fuser that includes one or more fuser elements, and a dynamic power management module that determines a total power available for warm-up of the fuser elements in the fuser, determines power constraints of the fuser elements, selects a power allocation to be applied to the fuser elements, calculates a fuser warm-up time based on the determined total power available, the determined power constraints, and the selected power allocation, determines whether the fuser warm-up time is reduced, wherein if the fuser warm-up time is reduced, the dynamic power management module applies the selected power allocation.

The disclosed embodiments further include a computer-readable medium that stores instructions for controlling a computing device for operating a fuser in a marking device. The fuser has a number of fuser elements associated therewith. The instructions may include determining a total power available for warm-up of fuser elements in a fuser, determining power constraints of the fuser elements, selecting a power allocation to be applied to the fuser elements, calculating a fuser warm-up time based on the determined total power available, the determined power constraints, and the selected power allocation, determining whether the fuser warm-up time is reduced, wherein if the fuser warm-up time is reduced, applying the selected power allocation.

FIG. 1 illustrates an exemplary diagram of a marking device 100 in accordance with one possible embodiment of the disclosure. The marking device 100 may represent any device (including a xerographic device) that may be capable of printing and/or making copies and uses synthetic (e.g., rubber) covered rollers or belts, including a large stand-alone office copier, a desktop copier, a printer, a multi-function device (MFD), etc., for example.

Figure 2:
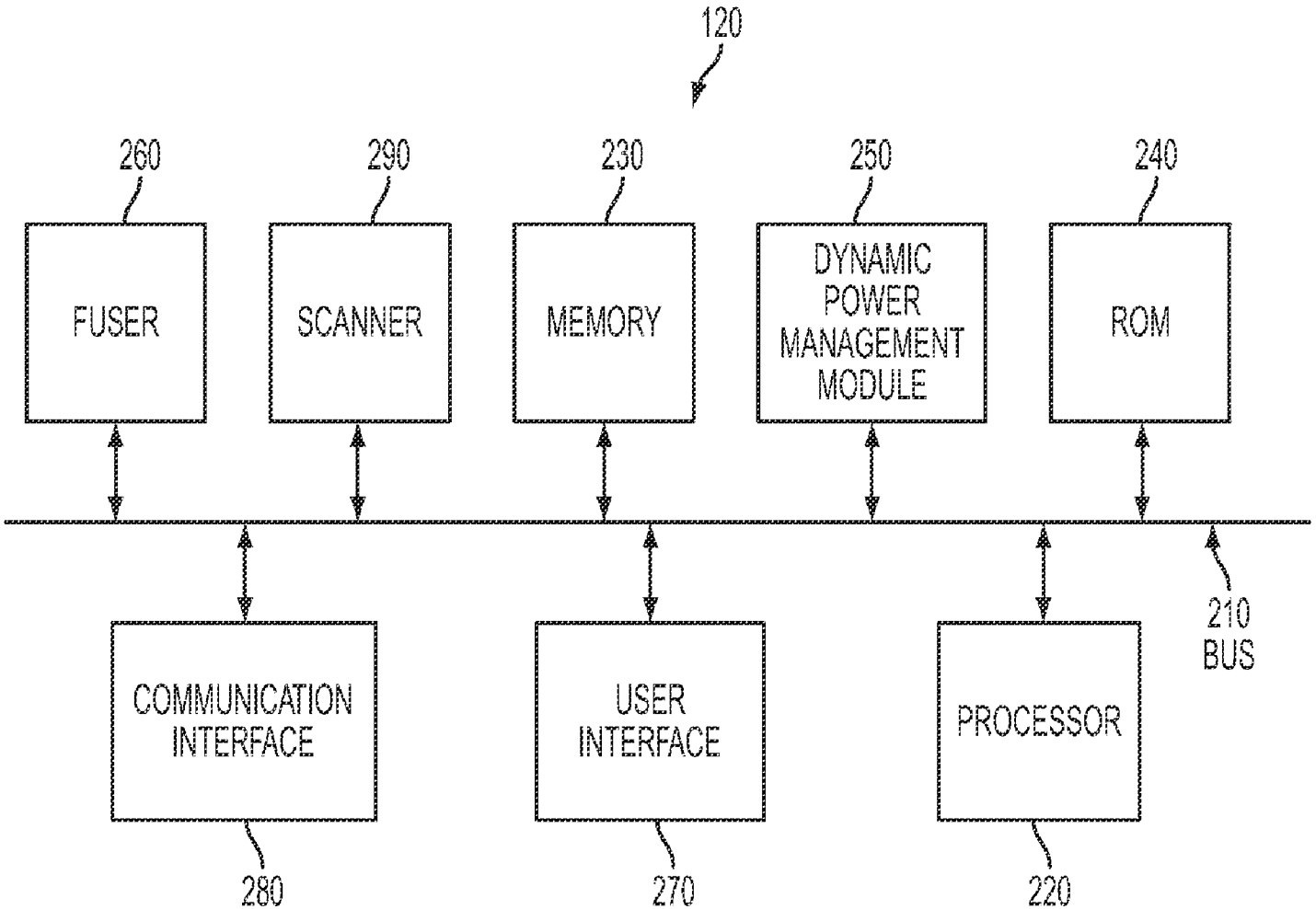
FIG. 2 illustrates a block diagram of a marking device in accordance with one possible embodiment of the disclosure.

FIG. 2 illustrates a block diagram of a marking device 100 in accordance with one possible embodiment of the disclosure. The marking device 100 may include may include a bus 210, a processor 220, a memory 230, a read only memory (ROM 240, a dynamic power management module 250, a fuser 260, a user interface 270, a communication interface 280, and a scanner 290. Bus 210 may permit communication among the components of the marking device 100.

Processor 220 may include at least one conventional processor or microprocessor that interprets and executes instructions. Memory 230 may be a random access memory (RAM) or another type of dynamic storage device that stores information and instructions for execution by processor 220. Memory 230 may also include a read-only memory (ROM) which may include a conventional ROM device or another type of static storage device that stores static information and instructions for processor 220.

Communication interface 280 may include any mechanism that facilitates communication via a local, remote or external network. For example, communication interface 280 may include a modem. Alternatively, communication interface 280 may include other mechanisms for assisting in communications with other devices and/or systems.

ROM 240 may include a conventional ROM device or another type of static storage device that stores static information and instructions for processor 220. A storage device may augment the ROM and may include any type of storage media, such as, for example, magnetic or optical recording media and its corresponding drive.

The user interface 270 may include one or more conventional input mechanisms that permit a user to input information, communicate with the marking device 100, and/or present information to the user, such as an electronic display, microphone, touchpad, keypad, keyboard, mouse, pen, stylus, voice recognition device, buttons, one or more speakers, etc. Output mechanisms for the user interface 270 may include one or more conventional mechanisms that output information to the user, including a display, a printer, one or more speakers, or a medium, such as a memory, or a magnetic or optical disk and a corresponding disk drive.

The scanner 290 may represent any scanner or scanning device known to those of skill in the art that may scan documents and/or images for processing.

The operation of the fuser 260 and the dynamic power management module 250 will be discussed further below in relation to FIGS. 3 and 4.

The marking device 100 may perform such functions in response to processor 220 by executing sequences of instructions contained in a computer-readable medium, such as, for example, memory 230. Such instructions may be read into memory 230 from another computer-readable medium, such as a storage device or from a separate device via communication interface 280.

The marking device 100 illustrated in FIGS. 1 and 2 and the related discussion are intended to provide a brief, general description of a suitable communication and processing environment in which the invention may be implemented. Although not required, the invention will be described, at least in part, in the general context of computer-executable instructions, such as program modules, being executed by the marking device 100, such as a communication server, communications switch, communications router, or general purpose computer, for example.

Generally, program modules include routine programs, objects, components, data structures, etc. that perform particular tasks or implement particular abstract data types. Moreover, those skilled in the art will appreciate that other embodiments of the invention may be practiced in communication network environments with many types of communication equipment and computer system configurations, including personal computers, hand-held devices, multi-processor systems, microprocessor-based or programmable consumer electronics, and the like.

Figure 3:
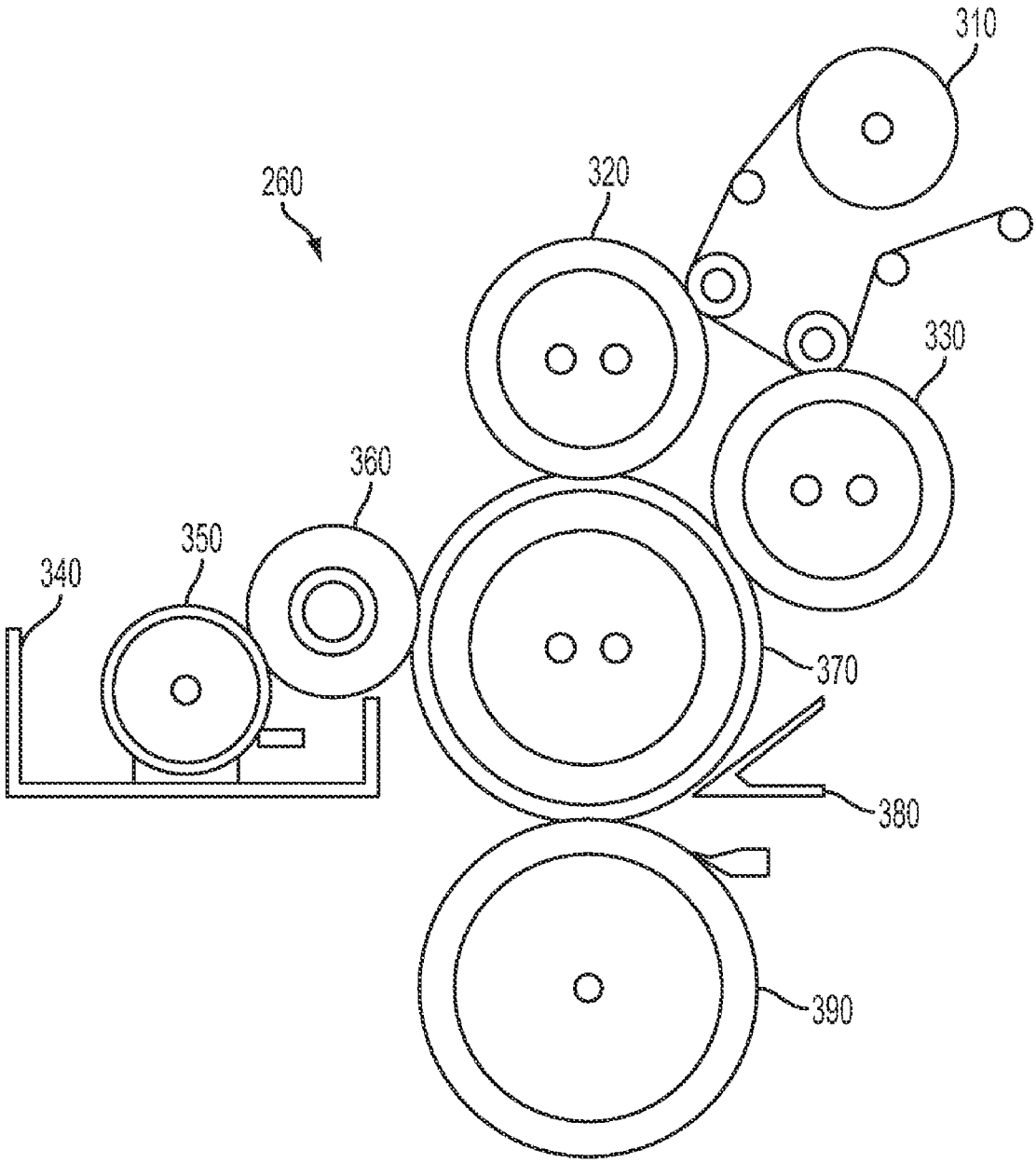
FIG. 3 illustrates a diagram of an exemplary fuser in accordance with one possible embodiment of the disclosure.

FIG. 3 illustrates a diagram of an exemplary fuser 260 in accordance with one possible embodiment of the disclosure. As is well-known in the marking art, the fuser 260 operates to provide heat to melt the toner for printing. The fuser 260 may contain a number of fuser elements that may include one or more rolls, belts, and other elements to perform this function. These rollers must be heated during the warm-up process. The fuser 260 may include cleaning web 310, external heat rolls 320, 330, oil container 340, meter roll 350, donor roll 360, fuser roll 370, air knife 380, and pressure roll 390.

Note that the diagram in FIG. 3 is merely shown as an example. The fuser 260 may be located in any printing and/or coping device, may contain synthetic (e.g., rubber) rollers or belts, and may be configured in a variety of different manners.

During the warm-up process, all the fuser roll or belt temperatures need to reach a set range. Some rolls or belts heat up fast and some slowly due to the difference in material, geometry, fuser element power, etc. The warm-up time is determined by the last roll or belt reaching its set range. For the exemplary fuser 260 depicted in FIG. 3, the warm-up time for the fuser 260 is constrained by the time for the fuser roll 370 surface temperature to reach ready-print temperature.

Figure 4:
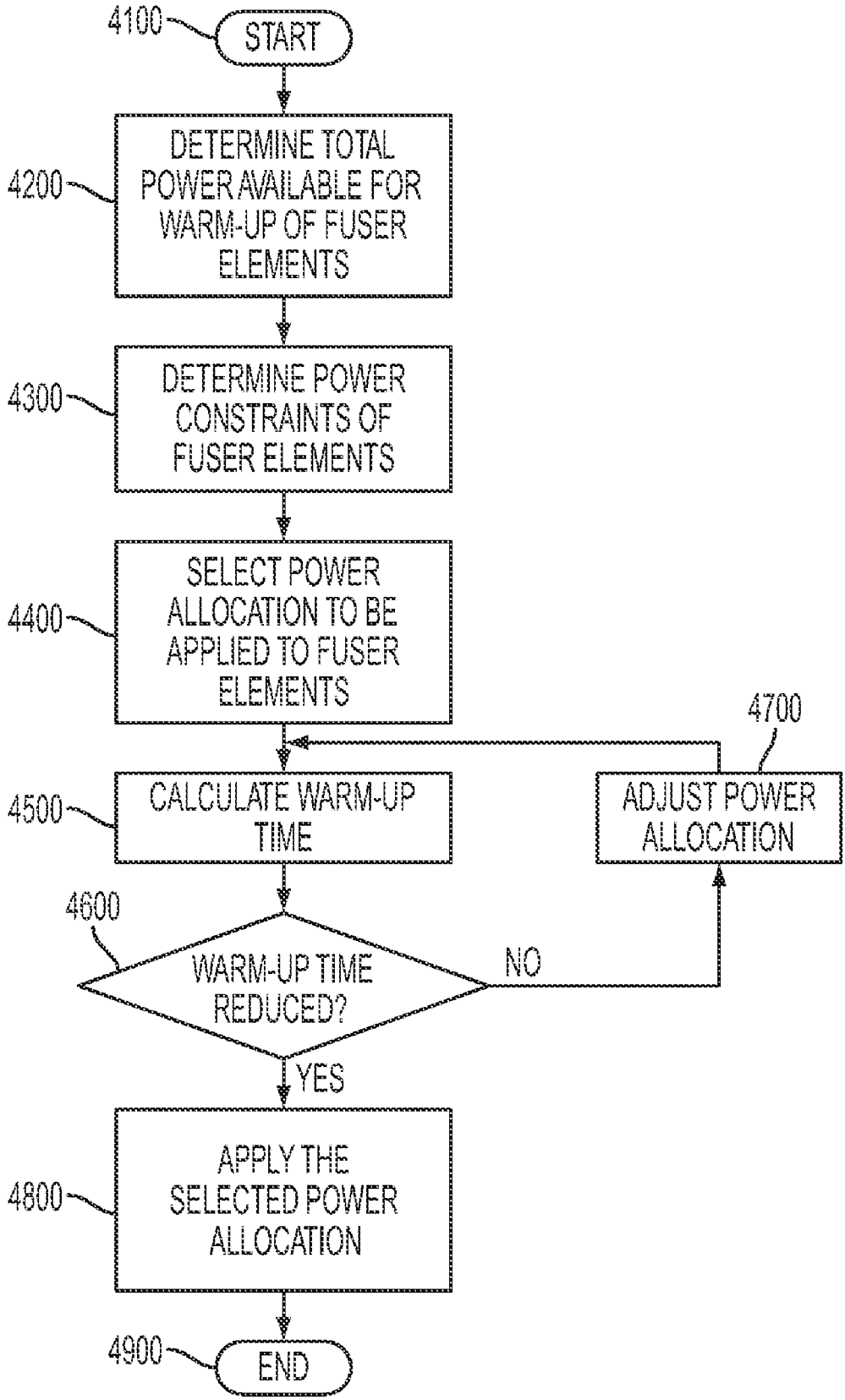
FIG. 4 is a flowchart of an exemplary dynamic power management process in accordance with one possible embodiment of the disclosure.

For illustrative purposes, the operation of the dynamic power management module 250 and the dynamic power management process are described in FIG. 4 in relation to the block diagrams shown in FIGS. 1-3.

FIG. 4 is a flowchart of an exemplary dynamic power management process in accordance with one possible embodiment of the disclosure. The process begins at 4100, and continues to step 4200 where the dynamic power management module 250 may determine the total power available for warm-up of fuser elements in a fuser 370. The total power must then be allocated to the various fuser elements.

At step 4300, the dynamic power management module 250 may determine the power constraints of the fuser elements. The power constraints may include the temperature limits to avoid debonding of the synthetic surface of the rolls or belts, the warm-up times of each roll for a given power, the synthetic material on each roll or belt and its respective heat transfer property, etc.

At step 4400, the dynamic power management module 250 may select an initial power allocation to be applied to the fuser elements. This initial power allocation may be determined at the factory, manually, when the machine is first turned on, or each time (or at various times) the machine is turned on, for example. The initial power allocation may be found in a stored table, or memory register, for example, and may be adjusted for the changing properties of the fuser elements over time for a given number of copies, age of the machine/element, etc.

At step 4500, the dynamic power management module 250 may calculate a fuser warm-up time based on the determined total power available, the determined power constraints, and the selected power allocation. The optimal warm up time problem can be stated as follows:

Reduce (Minimize) Warm-up time

Subject to:

Total fuser element power<available power

Core temperature<$T_{core}$

Fuser temperature dynamics

Given the warm-up temperature set-point r, the fusing temperature control problem can be casted as a tracking problem. That is, at each time step, we solve a quadratic programming:

$$\frac{\text{Reduce}}{\text{Minimize}} S(k) = \sum_{i=1}^{P} \{r - x_{surf}(k+i)\}^2$$

Subject to:

$0<u<\bar{u}$ $x_{core}<T_{core}$

Fuser temperature dynamics

Where $x_{surf}$ is the fuser roll 370 surface temperature and $x_{core}$ is fuser roll 370 core temperature. The main idea of MPC is to choose the control action by repeatedly solving online an optimal control problem. This aims at minimizing a performance criterion S(k) over a future horizon P, subject to constraints on the manipulated inputs u and outputs $x_{core}$, where the future behavior is computed according to a model of the plant. Not only the magnitude of the input power can be constrained, but also the rate of input change can be added as a constraint.

At step 4600, the dynamic power management module 250 may determine whether the fuser warm-up time is reduced. If the dynamic power management module 250 determines that the warm-up power is not reduced, the process goes to step 4700 where the dynamic power management module 250 may adjust the selected power allocation. This step may also ensure that the core temperature does not reach an unacceptable level. The process then goes back to step 4500.

Once the dynamic power management module 250 determines that the warm-up power is reduced, the process goes to step 4800 and the dynamic power management module 250 may apply the selected or adjusted power allocation. The process then goes to step 4900, and ends.

Figure 5A:
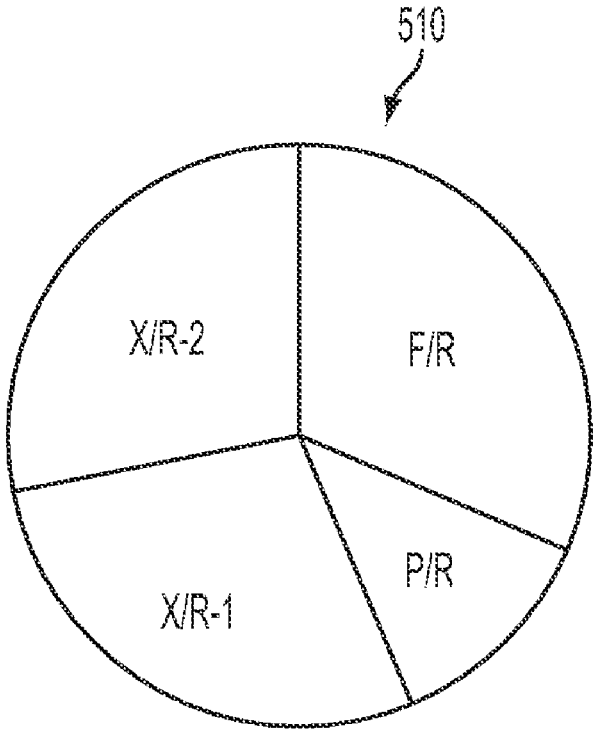
FIGS. 5A-5B illustrate exemplary pie charts showing power allocation before and after the dynamic power management process is applied in accordance with one possible embodiment of the disclosure.
Figure 5B:
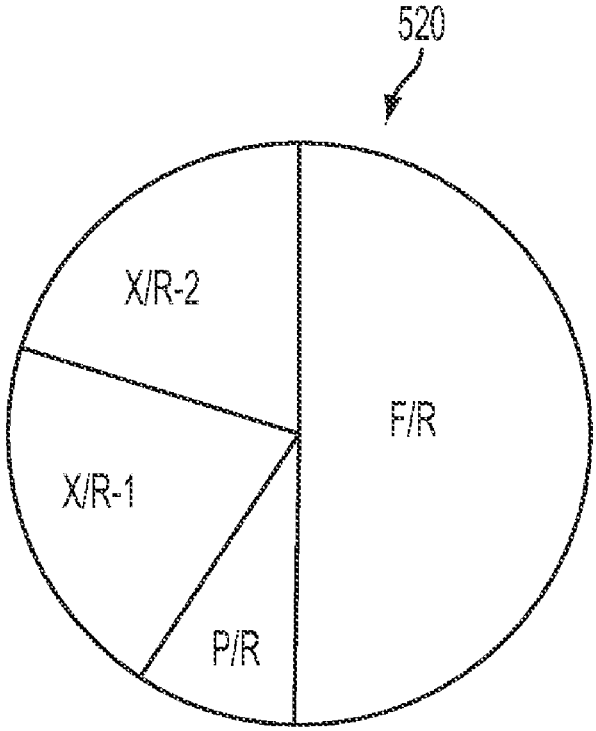

FIGS. 5A-5B exemplary pie charts showing power allocation before and after the dynamic power management process is applied, respectively, in accordance with one possible embodiment of the disclosure. The total fuser element power is constant. The pie chart in FIG. 5B shows that more power is provided to the fuser roll 370 because that takes the longest to heat up.

Figure 6A:
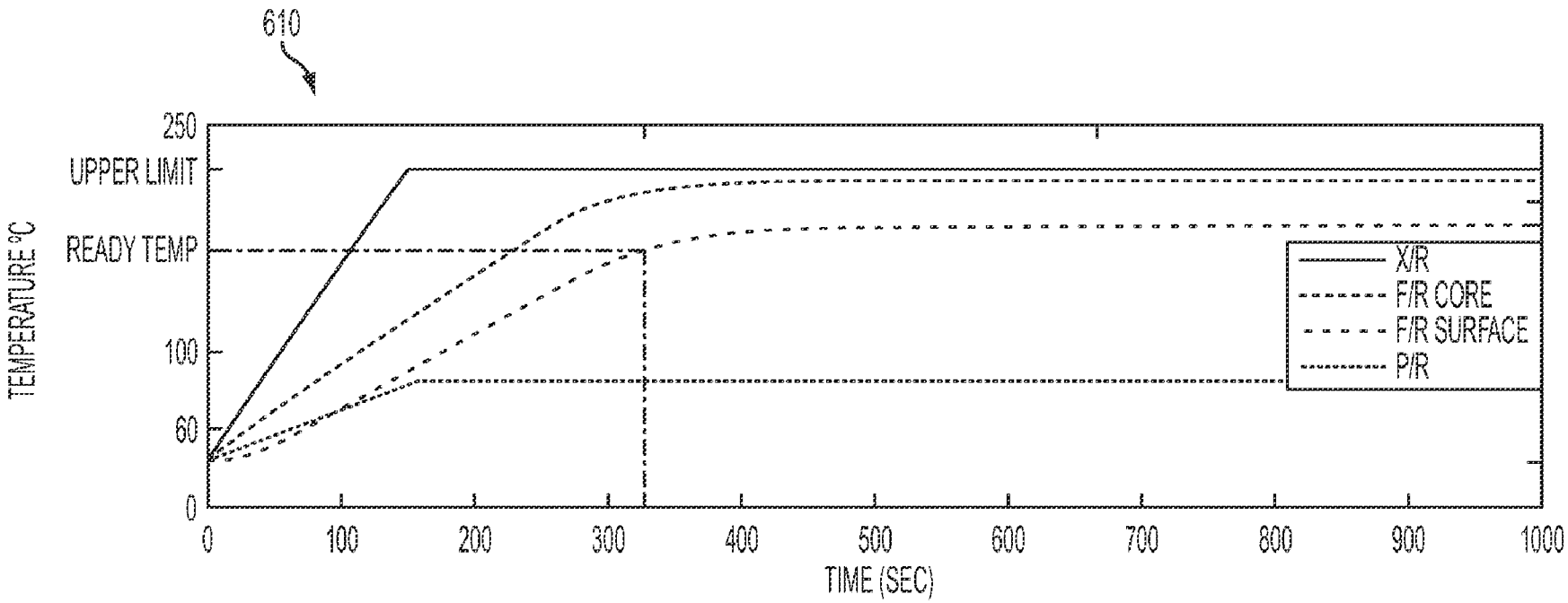
FIGS. 6A-6B illustrate exemplary graphs showing power allocation before and after the dynamic power management process is applied, in accordance with one possible embodiment of the disclosure.
Figure 6B:
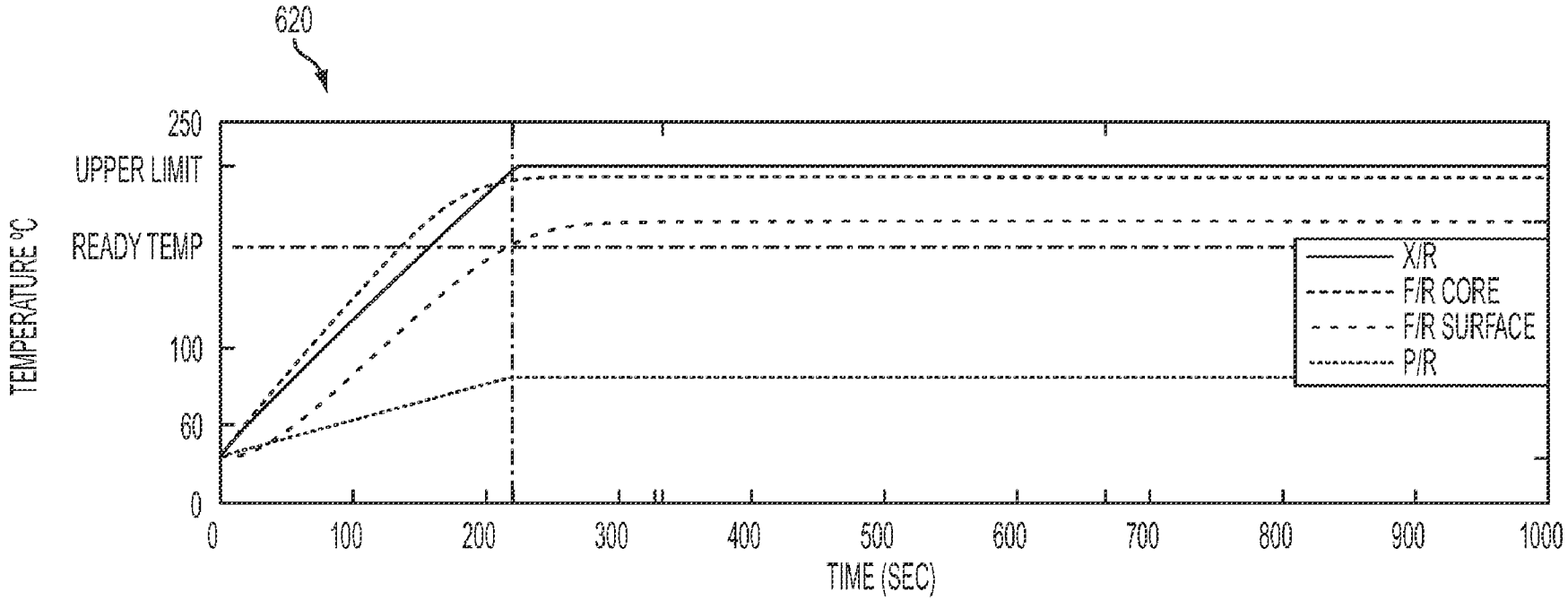

FIGS. 6A-6B illustrate exemplary graphs showing power allocation before and after the dynamic power management process is applied, respectively, in accordance with one possible embodiment of the disclosure. FIG. 6A is the temperature control with the current power allocation; while FIG. 6B is the temperature profile after optimization. Notice the fuser roll core temperature doesn't violate its upper bound $T_{core}$.

Embodiments as disclosed herein may also include computer-readable media for carrying or having computer-executable instructions or data structures stored thereon. Such computer-readable media can be any available media that can be accessed by a general purpose or special purpose computer. By way of example, and not limitation, such computer-readable media can comprise RAM, ROM, EEPROM, CD-ROM or other optical disk storage, magnetic disk storage or other magnetic storage devices, or any other medium which can be used to carry or store desired program code means in the form of computer-executable instructions or data structures. When information is transferred or provided over a network or another communications connection (either hard-wired, wireless, or combination thereof to a computer, the computer properly views the connection as a computer-readable medium. Thus, any such connection is properly termed a computer-readable medium. Combinations of the above should also be included within the scope of the computer-readable media.

Computer-executable instructions include, for example, instructions and data which cause a general purpose computer, special purpose computer, or special purpose processing device to perform a certain function or group of functions. Computer-executable instructions also include program modules that are executed by computers in stand-alone or network environments. Generally, program modules include routines, programs, objects, components, and data structures, and the like that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described therein.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A method for operating a fuser in a marking device, the fuser having a number of fuser elements associated therewith, comprising:

determining a total power available for warm-up of fuser elements in a fuser;

determining power constraints of the fuser elements; selecting a power allocation to be applied to the fuser elements;

calculating a fuser warm-up time based on the determined total power available, the determined power constraints, and the selected power allocation; and determining whether the calculated fuser warm-up time is reduced, wherein if the calculated fuser warm-up time is reduced, applying the selected power allocation.

2. The method of claim 1, wherein if the fuser warm-up time is not reduced, adjusting the selected power allocation; and applying the adjusted power allocation.

3. The method of claim 1, wherein the determined power constraints include warm-up times of all fuser elements.

4. The method of claim 1, wherein the fuser elements include at least one of rolls and belts.

5. The method of claim 4, wherein the rolls and belts are covered with a synthetic material.

6. The method of claim 1, wherein the determined temperature constraints include fuser element overheat and power supply limit.

7. The method of claim 1, wherein the marking device is one of a copier, printer, and multi-function device.

8. The method of claim 1, wherein the calculating step is performed using model predictive control.

9. A fusing apparatus in a marking device, comprising:

a fuser that includes one or more heating elements; and a dynamic power management module that determines a total power available for warm-up of the fuser elements in the fuser, determines power constraints of the fuser elements, selects a power allocation to be applied to the fuser elements, calculates a fuser warm-up time based on the determined total power available, the determined power constraints, and the selected power allocation, determines whether the fuser warm-up time is reduced, wherein if the fuser warm-up time is reduced, the dynamic power management module applies the selected power allocation.

10. The fusing apparatus of claim 9, wherein if the fuser warm-up time is not reduced, the dynamic power management module adjusts the selected power allocation and applies the adjusted power allocation.

11. The fusing apparatus of claim 9, wherein the determined power constraints include warm-up times of all fuser elements.

12. The fusing apparatus of claim 9, wherein the fuser elements include at least one of rolls and belts.

13. The fusing apparatus of claim 12, wherein the rolls and belts are covered with a synthetic material.

14. The fusing apparatus of claim 9, wherein the determined power constraints include a fuser element overheat and power supply limit.

15. The fusing apparatus of claim 9, wherein the marking device is one of a copier, printer, and multi-function device.

16. The fusing apparatus of claim 9, wherein the dynamic power management module calculates fuser warm-up time using model predictive control.

17. A computer-readable medium storing instructions for controlling a computing device for operating a fuser in a marking device, the fuser having a number of fuser elements associated therewith, the instructions comprising:

determining a total power available for warm-up of fuser elements in a fuser;

determining power constraints of the fuser elements;

selecting a power allocation to be applied to the fuser elements;

calculating a fuser warm-up time based on the determined total power available, the determined power constraints, and the selected power allocation; and determining whether the fuser warm-up time is reduced, wherein if the fuser warm-up time is reduced, applying the selected power allocation.

18. The computer-readable medium of claim 17, wherein if the fuser warm-up time is not reduced, adjusting the selected power allocation; and applying the adjusted power allocation.

19. The computer-readable medium of claim 17, wherein the determined power constraints include warm-up times of all fuser elements.

20. The computer-readable medium of claim 17, wherein the fuser elements include at least one of rolls and belts.

21. The computer-readable medium of claim 20, wherein the rolls and belts are covered with a synthetic material.

22. The computer-readable medium of claim 17, wherein the determined power constraints include fuser element overheat and power supply limit.

23. The computer-readable medium of claim 17, wherein the calculating instruction is performed using model predictive control.

* * * * *